United States Patent [19]

Anastasakis

[11] Patent Number: 4,869,501

[45] Date of Patent: Sep. 26, 1989

[54] BASKETBALL GOAL

[75] Inventor: Philip Anastasakis, Oshawa, Canada

[73] Assignee: Bryce Jones, Port Perry, Canada; a part interest

[21] Appl. No.: 164,264

[22] Filed: Mar. 4, 1988

[51] Int. Cl.[4] ..... A63B 63/00; F16M 11/00

[52] U.S. Cl. ..... 273/1.5 R; 248/161; 248/346

[58] Field of Search ..... 273/1.5 A, 1.5 R; 248/346, 161

[56] References Cited

U.S. PATENT DOCUMENTS

| | | | |
|---|---|---|---|
| 2,818,254 | 12/1957 | Dunn | 273/1.5 R |
| 2,838,308 | 6/1958 | Polite | 273/1.5 R |
| 3,017,183 | 1/1962 | Chalcroft | 273/1.5 R |
| 3,399,889 | 9/1968 | Harry | 273/1.5 R |
| 3,427,025 | 2/1969 | Procter | 273/1.5 R |
| 3,716,234 | 2/1973 | Lancellotti | 273/1.5 R |
| 4,522,394 | 6/1985 | Broussard | 273/1.5 R |

FOREIGN PATENT DOCUMENTS

| | | | |
|---|---|---|---|
| 632409 | 10/1963 | Belgium | 273/1.5 R |
| 2234942 | 12/1978 | Fed. Rep. of Germany | 273/1.5 R |
| 2920903 | 12/1980 | Fed. Rep. of Germany | 273/1.5 R |
| 977204 | 3/1951 | France | 273/1.5 R |
| 1341549 | 9/1963 | France | 273/1.5 R |
| 908055 | 10/1962 | United Kingdom | 273/1.5 R |
| 1055574 | 1/1967 | United Kingdom | 273/1.5 R |

OTHER PUBLICATIONS

The Aux-Z, Received in U.S. P.T.O. Mar. 22, 1983.

*Primary Examiner*—Edward M. Coven
*Assistant Examiner*—Gary Jackson
*Attorney, Agent, or Firm*—Rogers, Bereskin & Parr

[57] ABSTRACT

A movable basketball goal has a base and first and second support members extending up from the base. Each of the first and second support members comprises two separate elements, one of which is pivotally attached to the base. The other elements are pivotally attached together at their upper ends. A backboard support member extends from the upper ends of the support members, and a backboard and a goal basket are mounted on it. The two elements of each support member are movable relative to one another, to enable the goal to be collapsed to a compact configuration. Further, the goal basket can be movable relative to the backboard. The two elements of the first, forward support member can be separable from one another, while the two elements of the second, rear support member can be pivotally connected to one another.

18 Claims, 3 Drawing Sheets

BASKETBALL GOAL

FIELD OF THE INVENTION

This invention relates to a basketball goal, and more particularly relates to a collapsible and portable basketball goal.

BACKGROUND OF THE INVENTION

Basketball is a popular game. It requires the provision of two basketball goals at either end of the court. The court itself is ideally a smooth, flat surface. However, for recreational use, any suitable flat ground surface can be used. Thus, the game can be played at campsites and other locations. A difficulty arises in that conventional basketball goals are usually of a fixed or permanent construction. Also, they tend to be large and cumbersome.

For occasional recreational use, it is desirable that the basketball goals should be of relatively light weight and portable. There have been earlier proposals for basketball goals or equipment, which can be transported.

Thus, in U.S. Pat. No. 3,716,234 (Lancellotti), there is disclosed a collapsible basketball goal. The backboard itself is made up of two pivoted sections, which are held in an assembled position by means of stirrup members. The backboard is mounted on a collapsible upright support, formed from a number of tubular members interfitted into one another. Tubular leg members brace the upright member. Both the upright member and the tubular leg members are connected to a portable base. The base also serves as a carrying case. The leg members are relatively short and only support the upright member below the mid point thereof. This results in a relatively lightweight structure, which is not very rigid.

In U.S. Pat. No. 2,838,308 (Polite) there is disclosed a basketball game apparatus, which can be collapsed. However, this is achieved by providing a supporting framework directly under the basket itself. It is suggested that this provides a novel structure for removing balls from under the goal basket, after they have passed therethrough. The individual elements making up the supporting framework are relatively large, and even in the collapsed configuration they would occupy a large amount of space.

British patent specification Nos. 908,055 and 1,055,574, as well as U.S. Pat. No. 3,399,889 all disclose basketball goal constructions, which are similar in some ways. All these basketball goal constructions have an upright or vertical member. The actual backboard and basket are supported on one side of this member, and, on the other side of it, there is one or more cables to support the basket. Whilst this can provide a relatively simple construction, it has numerous disadvantages. It relies upon the weight of the backboard and basket to maintain the cable in tension. Thus, the construction is not particularly rigid or secure. Further, in these constructions, the upright member is generally in one piece. This makes the basketball goal unsuitable for transportation in, for example, a small vehicle.

Belgian patent No. 632,409 and German patent specification No. 2234942 disclose basketball stands, which rely upon a parallelogram linkage, to enable them to collapse. Although, in the case of the Belgian disclosure, the linkage is not a true parallelogram. However, in both cases, the constructions disclosed are relatively complex, and require numerous different members, with numerous different pivots. In the case of the Belgian disclosure, there are in effect two separate pivoted parallelogram or quadrilateral mechanisms on either side. Accordingly, this results in considerable complexity and cost.

A basketball stand manufactured by Toss Back Inc. of Dorrance, Kansas, has been marketed under the name "The AUX-Z". This appears to be a relatively sophisticated piece of apparatus, intended for a large sporting facility. As such, it does not appear suitable for domestic, recreational use. It has an inclined upright, with a column slidably received in it. The column supports the actual backboard and basket. The column can be moved vertically by means of a hydraulic system, which is described as being of aircraft quality. This can be provided with an electrically driven hydraulic pump. The upright is braced by two members extending from the back of the base. The apparatus is relatively heavy, having an empty weight in the range 700–820 pounds, and a gross weight including balast in the range 1100–1220 pounds. As such, it could not readily be carried around for use at campsites and the like.

SUMMARY OF THE PRESENT INVENTION

What is required is a simple, lightweight basketball stand. The stand should be of a rugged and durable construction. It should be capable of being collapsed into a small space, to enable it to be carried readily from place to place. Ideally, it should collapse to a size small enough to enable it to fit into the trunk of a car.

In accordance with the present invention, there is provided a movable basketball goal, which comprises: a base for receiving stabilizing weights; a first support member extending upwards from the base and comprising a first element pivotally attached at one end to the base and a second element having one end uppermost, with the other ends of the first and second elements being attached and movable relative to one another; a first locking means mounted between the first and second elements for locking the first and second elements in a erected position of the basketball goal; a second support member extending from the base and comprising a third element pivotally attached at one end to the base and a fourth element, which has one end pivotally attached to said one end of the second element, with the other ends of the third and fourth elements attached and movable relative to one another; a second locking means mounted between the third and fourth elements for locking the third and fourth elements in said erected position, said one ends of the second and fourth elements forming an upper corner of a stable triangulated structure in the erected position of the basketball goal, the first and second support members and the base each forming one side of the stable triangulated structure, and the first and second locking means being capable of release said elements whereby the basketball goal is collapsible to a compact, low profile configuration with all said elements generally parallel to the base; a backboard support member mounted to said upper corner of the stable triangulated structure; a backboard mounted on the backboard support member; and a goal basket mounted to the backboard.

Preferably, the other ends of the first and second elements slidably engage on another, and can be detached. The other ends of the third and fourth elements are, in this case, then preferably pivotally attached to one another and arranged to be clamped in a rigid elongate configuration. This enables the basketball goal to be readily collapsed. The first and second elements are disengaged from one another, and the third and fourth elements rotated relative to one another, to collapse the goal to a compact configuration.

The actual basket can be of adjustable height. This can be achieved by making the backboard support member slidable relative to the second support member. Further, the backboard with the basket goal and backboard support member can be removed from the other components, for transportation and storage.

By providing a base, which does not actually include any stabilizing weights, but is adapted to receive them, enables the basketball goal to be of a light weight. At a campsite and other places, there are usually many articles that can be used as suitable weights. Thus, the base is provided with a suitable plate or frame, on which can be placed gas cylinders, containers of water etc.

BRIEF DESCRIPTION OF THE SEVERAL VIEWS OF THE DRAWINGS

For a better understanding of the present invention, and to show more clearly how it may be carried into effect, reference will now be made, by way of example, to the accompanying drawings, in which.

DETAILED DESCRIPTION

Figure 1:
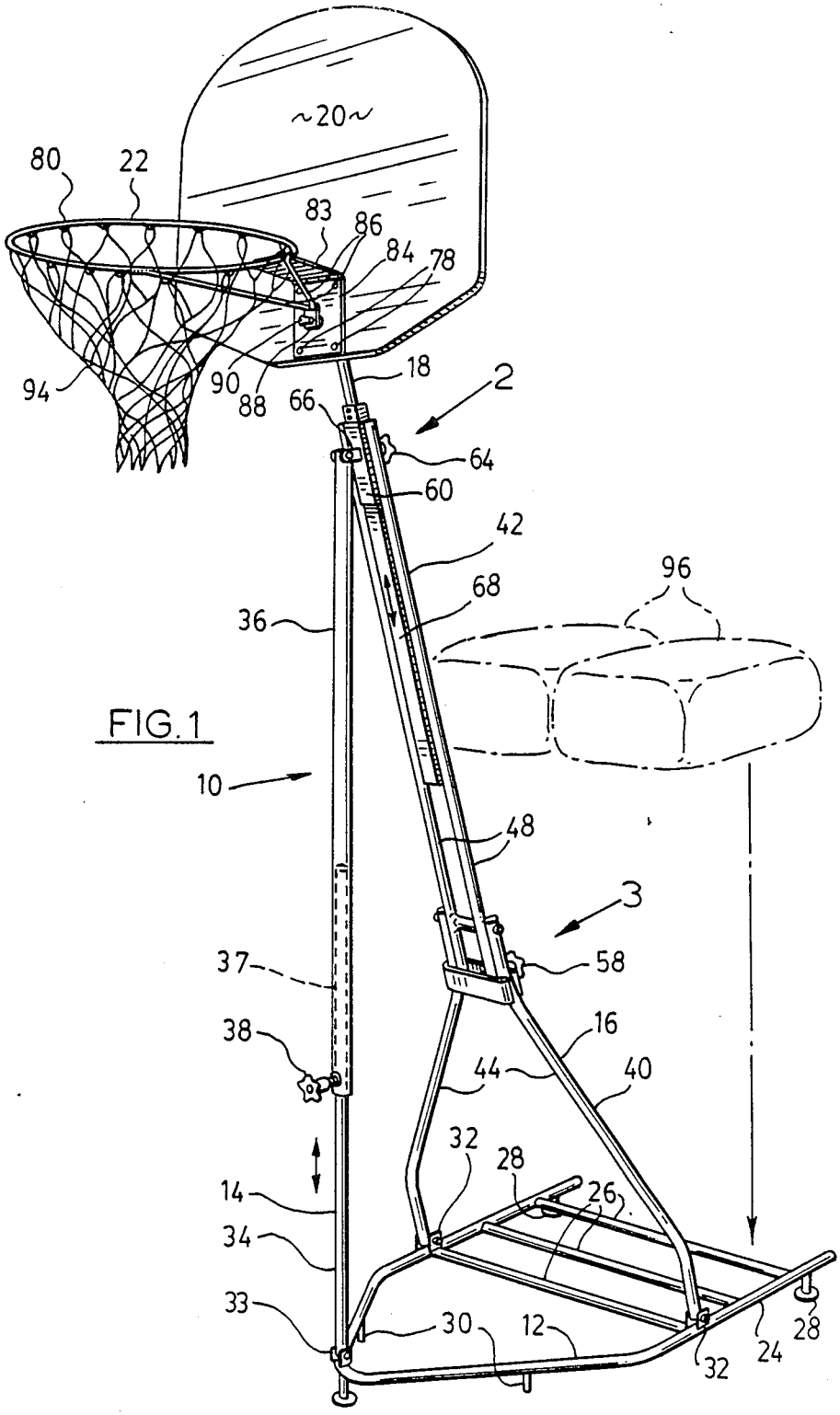
FIG. 1 shows a perspective view of an apparatus in accordance with the present invention.

With reference to FIG. 1, there is shown a movable basketball goal or apparatus, generally denoted by the reference 10. The apparatus 10 has a base 12, a first support member 14 and a second support member 16. A backboard support member 18 is mounted to the second support member 16, and supports a backboard 20. The goal basket 22 is secured to the backboard 20.

The base 12 has an outer tubular member 24, which is bent to form a generally U-shaped. Between the two rearwardly extending legs of the member 24, there are those cross tubes 26. At the front of the member 24, and at the rear end of its legs, there are supporting feet 28. These supporting feet 28 can be threaded and adjustable. Additional supporting members can be provided as indicated at 30. U-shape brackets 32 and a U-shape bracket 33 are provided for the support members 14, 16. The brackets 32, 33 are provided with openings for a pivot bolt.

The first support member 14 comprises a first tube element 34 and a second tube element 36. The first tube element 34 is of smaller diameter than the second tube element 36 and is received within it, as indicated at 37. The lower end of the first tube element 34 is pivotally attached to the bracket 33 by a bolt. A locking knob 38 is provided at the lower end of the second tube element 36. It can be rotated, to clamp the tube elements 34, 36 relative to one another.

Figure 3:
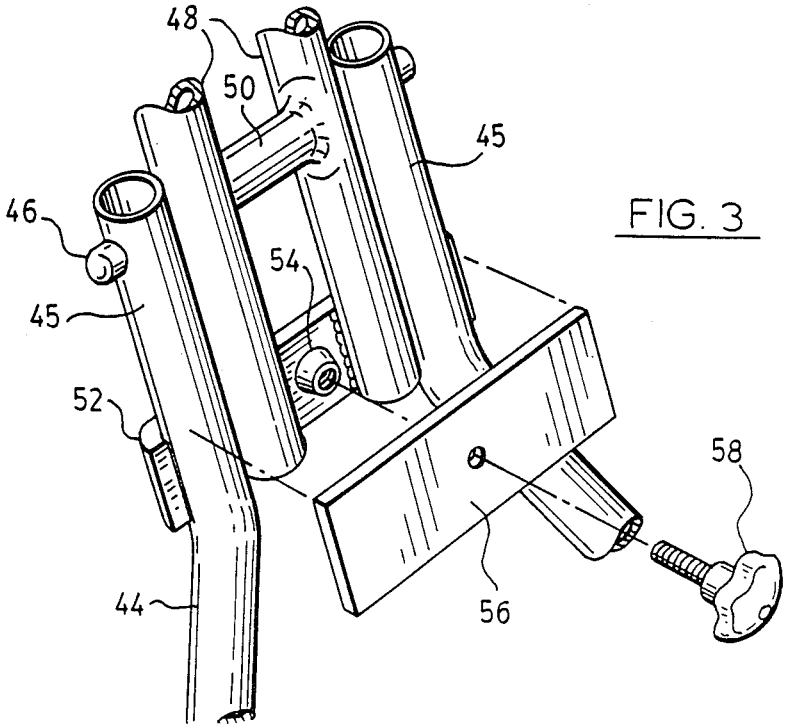
FIG. 3 shows a perspective view, on an enlarged scale, of the detail 3 of FIG. 1.
Figure 4:
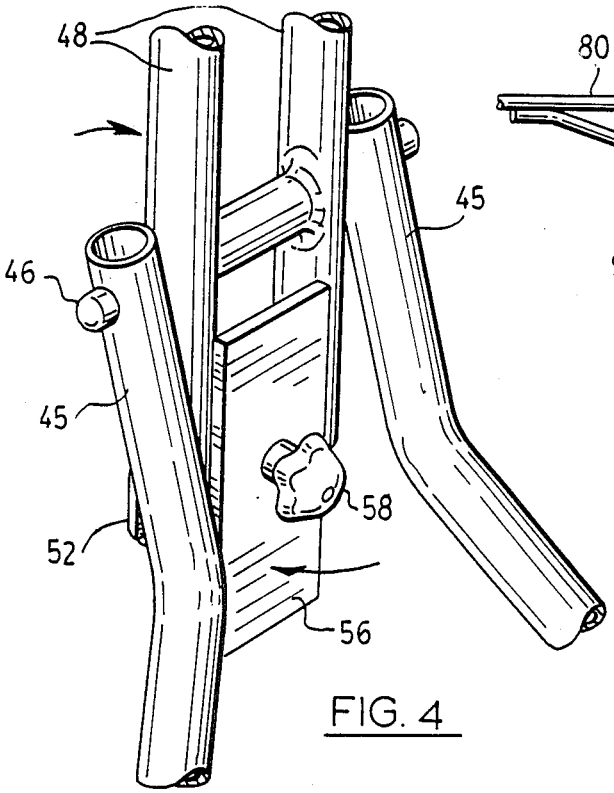
FIG. 4 shows a perspective view, similar to FIG. 3, showing operation of the apparatus.

The second support member 16 comprises a third element 40 and a fourth element 42. The third element 40 comprises two side elements 44. Each side element 44 has ends extending parallel to the axis of the second support member 16 and an inclined central part. The lower end of each side member 44 is pivotally attached to a respective bracket 32. The arrangement of the upper ends of the side members 44 is best seen in FIGS. 3 and 4, where the upper ends of the side members 44 are denoted by the reference 45. The upper ends 45 are joined together by a shaft or bolt 46 extending through them.

The fourth element 42 comprises two parallel tubes 48. As shown in FIG. 3 and 4, the lower ends of the tubes 48 are joined by a short cross tube 50, which pivots on the bolt 46. At the lowermost ends of the tubes 48, there is a first locking plate 52. The locking plate 52 is provided with a threaded bore 54. This can be provided by a nut welded to the plate 52. A second locking plate is shown at 56. This second plate 56 has a plane bore. A second locking knob 58 is provided, and includes a threaded shaft for engaging the threaded bore 54, as indicated in FIG. 3.

Figure 2:
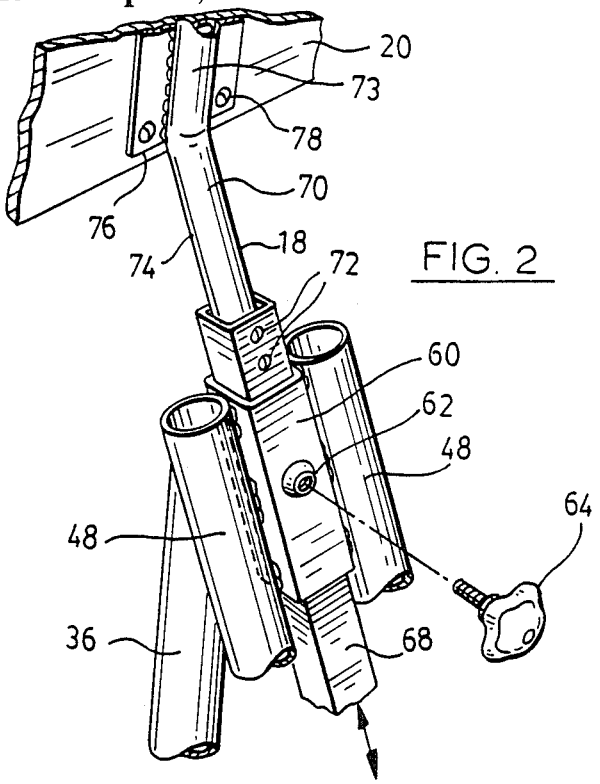
FIG. 2 shows a perspective view, on an enlarged scale, of the detail 2 of FIG. 1.

With reference to FIG. 2, the upper ends of the tubes 48 are secured, as by welding, to a guide member 60. The guide member 60 comprises a square section tube, and includes a threaded bore 62. Again, the threaded bore 62 can be provided by a nut welded to the guide member 60. A third locking knob 64 includes a threaded shaft engaged with the bore 62. Referring back to FIG. 1, the guide member 60 has a U-shape bracket member 66 secured to it. This bracket 66 is pivotally attached to the second tube element 36 of the first support member 14. As shown, this forms a stable triangulated structure, with each of the first and second support members 14, 16 and the base 12 forming one side of the triangulated structure.

The guide member 60 slidably receives the backboard support member 18. The backboard support member 18 comprises a lower, square section tube 68. This tube 68 is of smaller dimensions than the guide member 60, so as to be slidably mounted within it, as shown in FIG. 2. An upper, round tube 70 is secured within the square section tube 68, by means of a pair of screws 72.

With reference to the configuration of FIG. 1, the upper tube 70 includes a vertical part 73 and an inclined part 74. As shown in FIG. 2, the vertical part 73 is welded to a plate 76. The plate 76 is secured by four screws 78 to the backboard 20.

The goal basket 22 includes a ring or rim 80. A hinge 82 comprises two plates 83, 84. The plate 83 is secured, as by welding, to the ring 80. The plate 84 is secured by the screws 78 to the backboard 20.

Figure 5:
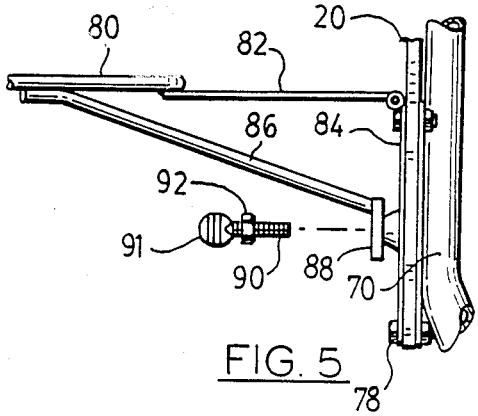
FIG. 5 shows a side view, on an enlarged scale, of part of the backboard and basket goal of the apparatus.

Two bracing wires or members 86 are secured to the ring 80, and also to an abutment member 88. The bracing members 86 can be formed from a single length of wire or the like. The abutment member 88 includes a threaded bore for a securing member 90. The plate 84 includes a corresponding threaded bore, which again can be provided by a nut welded to the plate 84. This enables the securing member 90 to secure the abutment member 88 to the plate 84. As shown in FIG. 5, the securing member 90 can comprise a threaded member 91 with a head, on which a nut 92 is mounted.

In know manner, a net 94 is provided to form the basketball goal.

In FIG. 1, the basketball goal 10 is shown in an erected position, ready for use. In this configuration, the second locking knob 58 is secured, to make the second support member 16 rigid. Similarly, the first locking knob 38 is secured, to make the first support member 14 rigid. The first support member 14 is adjusted, to make the backboard 20 vertical, and in this respect, the adjustable first support member 14 can overcome irregularities in the ground surface. The feet 28, if adjustable, would also be adjusted to level the apparatus 10.

The mounting of the backboard support member 18 in the guide member 60 enables the height of the goal basket 22 to be adjusted. With the locking knob 64 loosened, the goal basket 22 can be raised and lowered as desired. The locking knob 64 is then used to clamp the square tube 68, to secure the goal bracket 22 at a desired height.

In this configuration, the securing member 90 is firmly engaged in the plate 84, and the nut 92 can be used to secure the abutment member 88 against the plate 84. This securely braces the ring 80.

To stabilize the apparatus, weights are placed on the rear of the base 12. Such weights are indicated schematically at 96 in FIG. 1. They rest on the cross tubes 26. A variety of weights are suitable for this purpose. Thus, cylinders of gas, large containers of water, or bags of sand and the like can be used. Further, the base 12 could be of any suitable configuration to receive the weights. Thus, the base 12 could be formed from sheet material, and further could be adapted to receive weights both at its forward and rear ends.

The basketball goal 10 is then ready for use. It could be used in the conventional manner, which needs no further description here.

For transportation and storage, the apparatus 10 is collapsed. The order in which the locking knobs are released, to enable the apparatus to be collapsed can be varied. Below, one, preferred way is described.

First, the locking knob 38 is released. This enables the tube elements 34, 36 to be separated from one another. Consequently, the second support member 16 together with the goal basket 22 can be swung backwards. The first tube element 34 can then be rotated backwards, so that it lies flat against the base 12, any weights on the base 12 having previously been removed.

The second locking knob 58 is then unscrewed, to release the connection between the third and fourth elements 40, 42. As shown in FIG. 4, the second locking plate 56 is then rotated through 90°, so as to be clear of the ends 45. The third element 40 can then be rotated relative to the fourth element 42, as shown in FIG. 4. This enables the third element 40 to be rotated about the brackets 32, until it is generally flat or horizontal above the base 12 and first tube element 34.

Before lowering the fourth element 42, the third locking knob 64 is released. This enables the backboard support member 18, together with the backboard 20 and goal basket 22 to be removed. The backboard support member 18 is slid out of the guide member 60.

Figure 6:
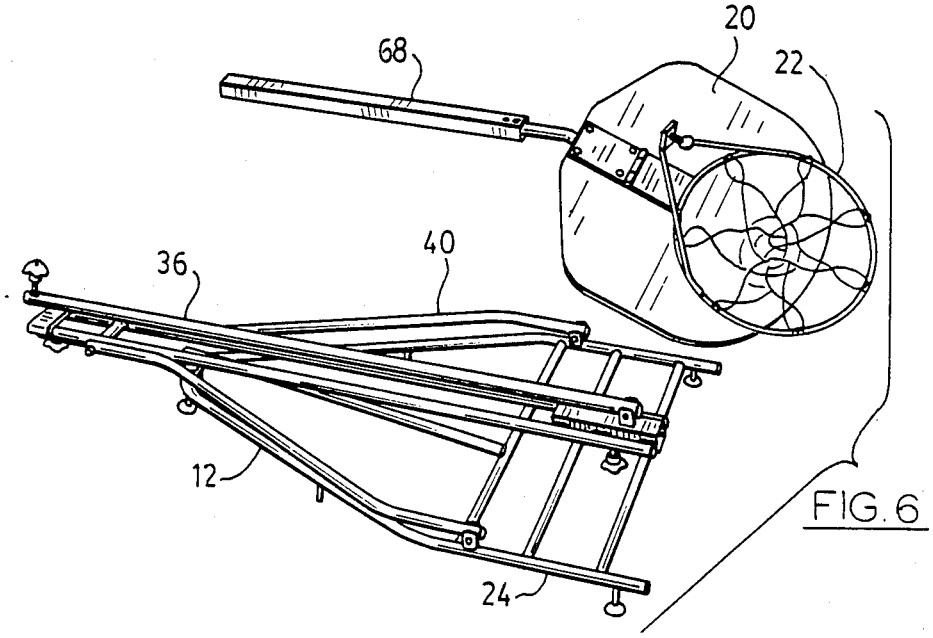
FIG. 6 shows a perspective view of the apparatus of FIG. 1 in a collapsed configuration.

As shown in FIG. 6, the fourth element 42 is then rotated backwards, until it is generally horizontal above the third element 40. The second tube element 36, now separate from the first tube element 34, is laid against the fourth element 42 and parallel to it.

To reduce the goal basket 22 to a more compact configuration, the securing member 90 is unscrewed or released from the plate 84. The ring 80 together with the net 94 is then swung upwards, until the ring 80 is against the backboard 20. This configuration is shown in the upper part of FIG. 6.

One then has the base 12 together with the support members 14, 16 in a lightweight compact and low configuration, ready for transportation and storage. All of the four elements 34, 36, 40 and 42 are then generally parallel to the base 12. The backboard support member 18 together with the backboard 20 and goal basket 22 have also been reduced to a compact configuration requiring little space. All these components are now capable of being carried in the trunk of a car or the like.

Whilst the apparatus could be made in various ways, it is preferred that it is made primarily from metal tubing, with the permanently secured parts welded together. Thus, for the first support member 14, the tube 34 could have a diameter of 7/8 of an inch, whilst the tube 36 would have a diameter of 1⅛ inch. The tubes of the second support member 16 could be 1 inches in diameter. The lower square section tube 68 could have a width of 1½ inches, with the guide member 60 having a width of 1¾ inches.

I claim:

1. A movable basketball goal, which comprises: a base for receiving stabilizing weights; a first support member extending upwards from the base and comprising a first element pivotally attached at one end to the base and a second element having one end uppermost, with the other ends of the first and second elements being attached and movable relative to one another; a first locking means mounted between the first and second elements for locking the first and second elements in an erected position of the basketball goal; a second support member extending from the base and comprising a third element pivotally atached at one end to the base and a fourth element, which has one end pivotally attached to said one end of the second element, with the other ends of the third and fourth elements attached and movable relative to one another; a second locking means mounted between the third and fourth elements for locking the third and fourth elements in a said erected position, said one ends of the second and fourth elements forming an upper corner of a stable triangulated structure in the erected position of the basketball goal, the first and second support members and the base each forming one side of the stable triangulated structure, and the first and second locking means being capable of releasing said elements whereby the basketball goal is collapsible to a compact, low profile configuration with all said elements generally parallel to the base; a backboard support member mounted to said upper corner of the stable triangulated structure; a backboard mounted on the backboard support member; and a goal basket mounted to the backboard.

2. A basketball goal as claimed in claim 1, wherein the first locking means includes a first locking knob for securing the first and second elements together, and wherein the other ends of the first and second elements are detachable from one another.

3. A basketball goal as claimed in claim 2, wherein the first and second elements comprise respective first and second tubes, with one of the first and second tubes being received within the other of the first and second tubes, and wherein the first locking knob includes a threaded shaft which engages a threaded bore of the other of the first and second tubes.

4. A basketball goal as claimed in claim 1, 2 or 3, wherein the backboard support member is slidably mounted relative to the first and second support members, and which includes a third locking means provided with a third locking knob, for adjusting the vertical height of the goal basket.

5. A basketball goal as claimed in claim 2, wherein the other ends of the third and fourth elements are pivotally attached to one another.

6. A basketball goal as claimed in claim 5, wherein the other ends of the third and fourth elements overlap one another, and wherein the second locking means includes a second locking knob for securing the other ends of the third and fourth elements together.

7. A basketball goal as claimed in claim 6, wherein the other ends of the third and fourth elements are pivotally attached about a pivot axis adjacent the other end of one of the third and fourth elements and spaced from the other end of the other of the third and fourth elements, and wherein the second locking means is provided adjacent the other end of the other of the third and fourth elements.

8. A basketball goal as claimed in claim 7, wherein the second locking means comprises a first locking plate secured to the other end of the other of the third and fourth element and including a threaded bore, the second locking knob which includes a threaded shaft engaging the threaded bore of the first locking plate, and a second locking plate having a bore through which the threaded shaft of the second locking knob extends, the first and second locking plates being arranged for clamping the third and fourth elements relative to one another.

9. A basketball goal as claimed in claim 8, wherein the third element comprises two side members, each of which is pivotally attached at one end to the base, and the fourth element comprises two parallel members, the one ends of which are pivotally attached to the first support member and the other ends of which are secured to the first locking plate, with the other ends of the side members of the third element pivotally attached to the fourth element at a location spaced from the first locking plate.

10. A basketball goal as claimed in claim 8, wherein the fourth element of the second support member includes a tubular guide member which is pivotally attached to said one end of the second element, includes a threaded bore, and is secured to said one ends of the parallel side members thereof, and wherein the backboard support member is slidably received within the tubular guide member and wherein a third locking knob is provided which includes a threaded shaft engaging the threaded bore of the tubular guide member.

11. A basketball goal as claimed in claim 10, wherein the tubular guide member comprises a square section tube, and wherein the backboard support member includes a square tube slidably received within the tubular guide member.

12. A basketball goal as claimed in claim 10, wherein the goal basket includes a hinge secured to the backboard, and a ring attached to the backboard by the hinge, to enable the ring to be rotated relative to the backboard.

13. A basketball goal as claimed in claim 12 in which the goal basket includes bracing means, which is secured to the ring at one end and which is attachable to the backboard at the other end, for bracing the ring relative to the backboard.

14. A basketball goal as claimed in claim 13, wherein the bracing means comprises a pair of bracing members attached at one end to the ring, an abutment member secured to the other ends of the bracing members and including a threaded bore, and a threaded securing member engaging the threaded bore of the abutment member, with the backboard including a threaded bore for receiving the threaded securing member.

15. A basketball goal as claimed in claim 14, wherein the backboard support member includes an upper, round tube, which is secured to said square tube, and a mounting plate to which the upper, round tube is secured, and wherein the mounting plate abuts one side of the backboard and the hinge abuts the other side of the backboard with common screws securing the hinge and the mounting plate to the backboard.

16. A basketball goal as claimed in claim 12, wherein the base comprises a U-shape tube having legs extending rearwardly, and a plurality of cross tubes secured to the legs of the U-shape tube at the rear of the base for receiving weights, and wherein the first tube of the first support member is pivotally attached to the U-shape tube at a forward end thereof, and the side members of the third element are pivotally attached to the legs of the U-shape tube.

17. A basketball goal as claimed in claim 1, 2 or 6, backboard and a ring attached to the backboard by the hinge, to enable the ring to be rotated relative to the backboard.

18. A basketball goal as claimed in claim 1, 2 or 6, wherein the base comprises a U-shape tube member, and a plurality of cross tubes secured to legs of the U-shape tube member.

* * * * *